US007604265B2

(12) United States Patent
Tsai

(10) Patent No.: US 7,604,265 B2
(45) Date of Patent: Oct. 20, 2009

(54) LATCH ASSEMBLY FOR SLIDING DOORS

(75) Inventor: Miao Hsueh Tsai, Taichung (TW)

(73) Assignee: Imperial USA, Ltd., Charlotte, NC (US)

( * ) Notice: Subject to any disclaimer, the term of this patent is extended or adjusted under 35 U.S.C. 154(b) by 414 days.

(21) Appl. No.: 11/389,987

(22) Filed: Mar. 27, 2006

(65) Prior Publication Data

US 2007/0222228 A1 Sep. 27, 2007
US 2009/0008946 A9 Jan. 8, 2009

Related U.S. Application Data

(63) Continuation-in-part of application No. 10/979,662, filed on Nov. 4, 2004, now abandoned.

(51) Int. Cl.
*E05C 9/16* (2006.01)
*E05C 19/10* (2006.01)

(52) U.S. Cl. ..... 292/26; 292/5; 292/24; 292/27; 292/28; 292/31; 292/95; 292/116; 292/121; 292/DIG. 46; 70/95; 70/100

(58) Field of Classification Search ..... 292/5, 292/24–28, 31, 95–97, 116, 117, 121, DIG. 46; 70/95, 100, 224
See application file for complete search history.

(56) References Cited

U.S. PATENT DOCUMENTS

| | | | | |
|---|---|---|---|---|
| 703,976 | A | | 7/1902 | Southard |
| 959,494 | A | | 5/1910 | Fisher |
| 1,907,641 | A | | 5/1933 | Askin |
| 1,911,464 | A | | 5/1933 | Pearson |
| 2,349,367 | A | | 5/1944 | Muffly |
| 2,702,460 | A | | 2/1955 | Gaugler |
| 3,019,043 | A | * | 1/1962 | Woodworth et al. ..... 292/113 |
| 3,744,829 | A | | 7/1973 | Germer |
| 3,899,201 | A | | 8/1975 | Paioletti |
| 4,703,628 | A | | 11/1987 | Togashi et al. |
| 4,958,508 | A | | 9/1990 | Lin |
| 5,125,703 | A | | 6/1992 | Clancy et al. |

(Continued)

FOREIGN PATENT DOCUMENTS

EP 0 661 409 A2 7/1995

(Continued)

*Primary Examiner*—Carlos Lugo
(74) *Attorney, Agent, or Firm*—Alston & Bird LLP

(57) ABSTRACT

A latch assembly for a door includes a housing composed of a base and a cover. A drive knob, two links, two hooks, two adjusting members, and two torsion springs are connected between the base and the cover. The drive knob includes a drive surface that is engaged with a straight inside portion of a through hole of the links. One of the two links is pivotably connected to an adjusting portion of the other link and retaining slot of one of the two hooks. The other link has a positioning portion that is pivotably connected to the retaining slot of the other hook. When the drive knob is rotated in a particular direction (typically counterclockwise), the two links are pivoted in opposite directions and the two hooks are pivoted in two opposite directions and extend through apertures in the first outer surface of the base to hook a keeper structure and secure the door.

15 Claims, 5 Drawing Sheets

U.S. PATENT DOCUMENTS

| | | | | |
|---|---|---|---|---|
| 5,595,409 | A | 1/1997 | Fier et al. | |
| 5,642,909 | A | 7/1997 | Swan et al. | |
| 5,722,704 | A | 3/1998 | Chaput et al. | |
| 5,820,170 | A | 10/1998 | Clancy | |
| 5,951,068 | A | 9/1999 | Strong et al. | |
| 6,264,252 | B1 | 7/2001 | Clancy | |
| 6,327,879 | B1 | 12/2001 | Malsom | |
| 6,672,632 | B1 * | 1/2004 | Speed et al. | 292/25 |
| 6,682,109 | B2 | 1/2004 | Horne et al. | |
| 6,688,656 | B1 * | 2/2004 | Becken | 292/26 |
| 6,776,441 | B2 | 8/2004 | Liu | |
| 7,040,671 | B2 * | 5/2006 | Su et al. | 292/24 |
| 2003/0061830 | A1 | 4/2003 | Ross | |
| 2003/0116973 | A1 * | 6/2003 | Liu | 292/26 |
| 2004/0145189 | A1 * | 7/2004 | Liu | 292/24 |
| 2004/0195841 | A1 * | 10/2004 | Liu et al. | 292/24 |
| 2004/0227349 | A1 * | 11/2004 | Denys | 292/26 |
| 2004/0245784 | A1 | 12/2004 | Tsai | |
| 2004/0256860 | A1 | 12/2004 | Tsai | |
| 2006/0071478 | A1 * | 4/2006 | Denys | 292/26 |
| 2006/0076783 | A1 * | 4/2006 | Tsai | 292/24 |
| 2006/0091679 | A1 * | 5/2006 | Tsai | 292/24 |
| 2006/0119108 | A1 | 6/2006 | Heid et al. | |
| 2007/0200355 | A1 * | 8/2007 | Liang et al. | 292/24 |
| 2007/0290511 | A1 * | 12/2007 | Liang et al. | 292/24 |

FOREIGN PATENT DOCUMENTS

| | | | | |
|---|---|---|---|---|
| GB | 2101667 | A | * | 1/1983 |
| GB | 2111582 | A | * | 7/1983 |
| GB | 2176834 | A | * | 1/1987 |
| GB | 2 196 375 | A | | 4/1988 |
| GB | 2 212 849 | A | | 8/1989 |
| GB | 2 265 935 | A | | 10/1993 |
| WO | WO 8606130 | A1 | * | 10/1986 |
| WO | WO 96/25576 | A1 | | 8/1996 |

* cited by examiner 94
92
80
85
102
8
1012
62
63
75
42
4
30
31
501
502
503
1011
61
43
7
91
60'
41
41'
90
40'
42'
501'
502'
503'
62'
95

94
92
80
85
102
8
1012
62
63
75
61
42
4
30
31
3
501
502
503
1011
43
7
91
60'
41
41'
90
40'
42'
502'
503'
501'
95
62'

LATCH ASSEMBLY FOR SLIDING DOORS

CROSS REFERENCE TO RELATED APPLICATION

This application is a continuation-in-part of U.S. application Ser. No. 10/979,662, filed on Nov. 4, 2004 now abandoned.

FIELD OF THE INVENTION

The present invention relates to a latch assembly and, more particularly, relates to a latch assembly that includes two adjustable hooks that can be pivoted in opposite directions by a driving mechanism, e.g., to secure a sliding door.

BACKGROUND OF THE INVENTION

A conventional patio sliding door typically includes a latch assembly that is connected to the lock face thereof. The latch assembly includes a hook that is operated by a control member so as to be pivoted and extended through the lock face to hook on a keeper structure in a jamb of a door frame. During the installation of such a door and/or latch assembly, the installer identifies the direction of use and the orientation of the sliding door so that the latch assembly can be installed and then operated as desired to secure the door. The planning and installation can be time consuming. For example, careful and time consuming planning may be required to identify the final desired operation and orientation of the door and the desired orientation and operation of the hook of the latch assembly. If the door is installed in the wrong orientation, the door may need to be uninstalled, typically requiring the installer to remove a number of screws, and/or the latch assembly may need to be removed and reinstalled in a different configuration, e.g., to change the direction of operation of the hook.

Thus, there exists a need for an improved latch assembly that can facilitate a simplified installation. The latch assembly should also provide a secure locking feature for the door. Preferably, the latch assembly should be adaptable for use with at least sliding doors.

SUMMARY OF THE INVENTION

The present invention generally relates to a latch assembly, e.g., for sliding doors. The latch assembly includes a case or housing that includes a base and a cover, with a drive knob, two links, two hooks, two adjusting members, and two torsion springs connected between the base and the cover. The drive knob defines a non-circular circumference (such as a D-shaped circumference) so that a drive surface of the knob engages a corresponding straight inside portion of a through hole of at least one of the links. One of the two links is pivotably connected to an adjusting portion of the other link and a retaining slot of one of the two hooks. The other link has a positioning portion pivotably connected to the retaining slot of the other hook. When the drive knob is rotated, typically in the counterclockwise direction, the two links are pivoted in opposite directions, and the two hooks are pivoted in two opposite directions and extend through apertures in an outer surface of the base to hook the keeper structure in the jamb of the door frame or another door, such as a fixed door.

According to one embodiment, the present invention provides a latch assembly for use in a sliding door for securing the door relative to a keeper structure of a door frame or another door. The latch assembly includes a housing that defines a first outer surface, and the housing is configured to be disposed in the door with the first outer surface directed toward the door frame. A drive knob is disposed in the housing and rotatably mounted to the housing. First and second links are also rotatably mounted in the housing. The first link defines an aperture for receiving the drive knob so that the first link is rotatable about the drive knob. The second link, which is supported by a pin mounted in the housing and thereby pinned to the housing, is engaged to the first link so that the second link is configured to rotate in a direction opposite to a rotation of the drive knob and the first link. First and second adjusting members are also disposed in the housing and rotatably mounted to the housing, and each adjusting member defines a slot. First and second hooks are rotatably mounted in the housing, and each hook defines a slot and a hook end. Each hook can be a single unitary member or can include multiple portions, e.g., multiple stacked plate-like members. First, second, third, and fourth pins, are provided for connecting the various members. In particular, the first pin extends through the first link and the slot in the first hook, the second pin extends through the second link and the slot in the second hook, the third pin extends through the first hook and the slot in the first adjusting member, and the fourth pin extends through the second hook and the slot in the second adjusting member. Thus, the first and second hooks are configured to rotate in opposite directions, and the hooks are configured to be selectively rotated between a retracted position and an extended position by a rotation of the drive knob so that, during adjustment to the extended position, the hook ends extend from the casing and rotate to engage the keeper structure, i.e., so that the keeper structure is disposed partially between each hook end and the door.

The latch assembly can also include first and second adjusting knobs for adjusting the hooks. Each knob is engaged with a respective one of the adjusting members and extends to the first outer surface, and each knob is configured to be adjusted to thereby adjust a position of the respective adjusting member relative to the first outer surface and thereby adjust the extended position of each hook end. In particular, each of the adjusting knobs can be rotatably connected to the housing and engaged via a threaded connection to the adjusting members so that the knobs are configured to be rotated after the latch assembly is installed in the door to adjust a distance defined between the first outer surface and a portion of each adjusting member and thereby adjust a distance defined between each hook end and the first outer surface when the hooks are in the extended position.

In one embodiment, the housing includes a base and a cover, both of which extend perpendicular to the first outer surface so that a space is defined between the base and cover. The drive knob extends through the base and cover, and each of the first and second links and first and second adjusting members are disposed in the space between the base and cover and pinned between the base and cover. The first, second, third, and fourth pins extend in an axial direction between the base and cover and can be adjusted in a transverse direction that is perpendicular to the axial direction when the drive knob is rotated.

One or more springs can be provided to bias the various members of the latch assembly. For example, at least one of the links can define a protrusion that is connected to one of the springs so that the protrusion is configured to compress the spring when the links are rotated by the drive knob. In one embodiment, two springs are provided. A first spring is connected to the third pin and the first adjusting member and configured to bias the third pin toward a first end of the slot in the first adjusting member, and the second spring is connected to the fourth pin and the second adjusting member and configured to bias the fourth pin toward a first end of the slot in the second adjusting member.

The housing can also include one or more flanges that extending parallel to the first outer surface and define first and second recesses. Each of the adjusting knobs can have a neck disposed in and retained by one of the recesses, and the first outer surface of the housing can define holes that correspond in position to each adjusting knob so that the knobs can be accessed and adjusted through the first outer surface, e.g., after the latch assembly is installed in the door to accommodate a particular keeper structure configuration with a keeper board having a particular thickness.

In one embodiment of the present invention, each adjusting member defines first and second substantially parallel portions, and each of the hooks is disposed between the first and second portions of a respective one of the adjusting members. That is, the first hook can be disposed between two portions of the first adjusting member, and the second hook can be disposed between two portions of the second adjusting member. Further, threaded nuts can be mounted on the first and second adjusting members. For example, a first nut can be disposed between the first and second portions of the first adjusting member, with the nut disposed in a limiting slot defined by each portion. Similarly, the second nut can be disposed between the first and second portions of the second adjusting member, with the nut disposed in a limiting slot defined by each portion. Each of the nuts can be threadably engaged to a respective one of the adjusting knobs so that a user can rotate the adjusting knobs to move the adjusting members toward or away from the keeper structure.

Thus, the present invention provides a latch assembly with two hooks that can be used to secure a door. The hooks typically operate in opposite directions and, in some cases, the latch assembly can be installed in alternate configurations, e.g., with either of the hooks configured to engage either of top and bottom portions of a keeper structure.

BRIEF DESCRIPTION OF THE DRAWINGS

Figure 1:
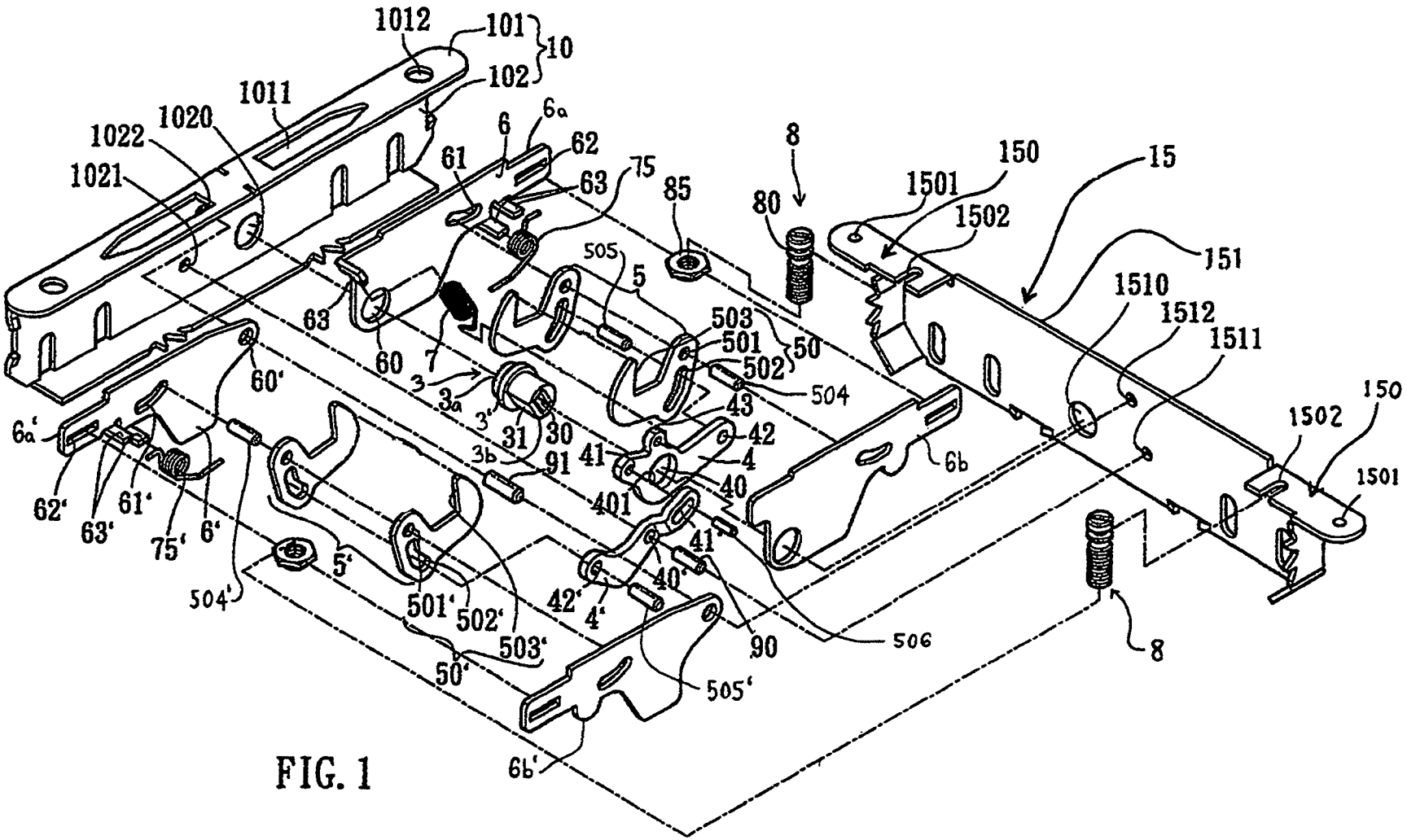
Figure 2:
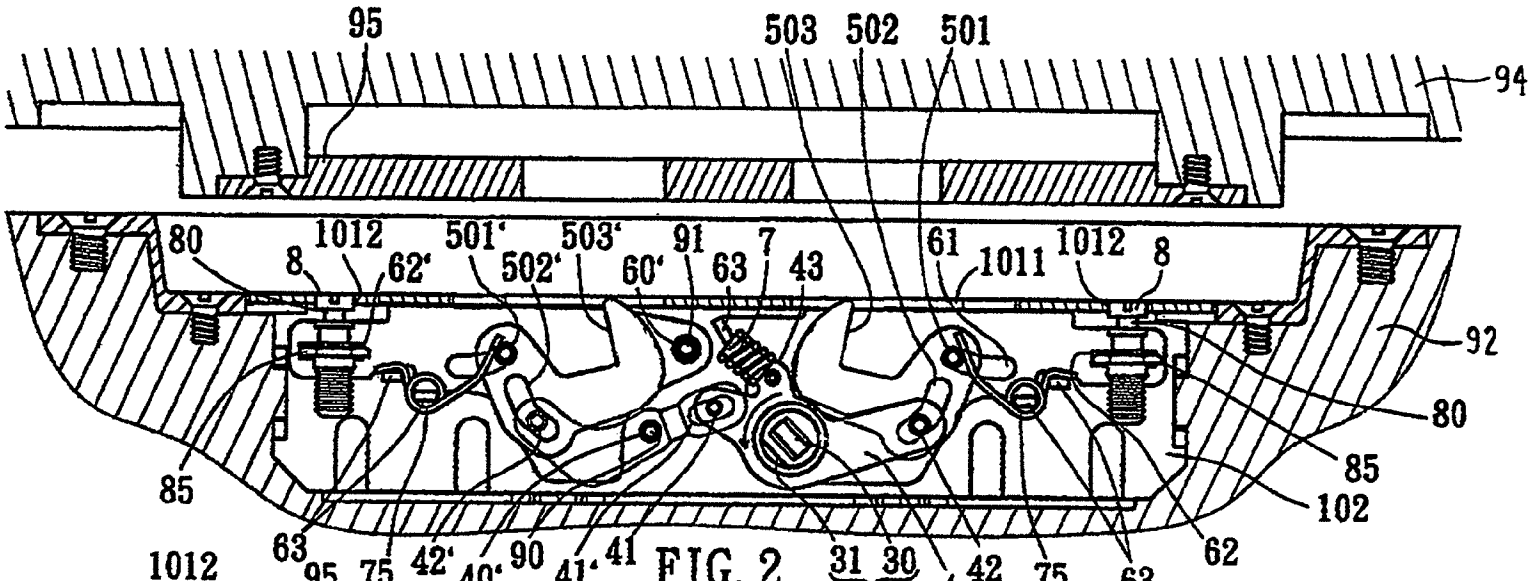
Figure 3:
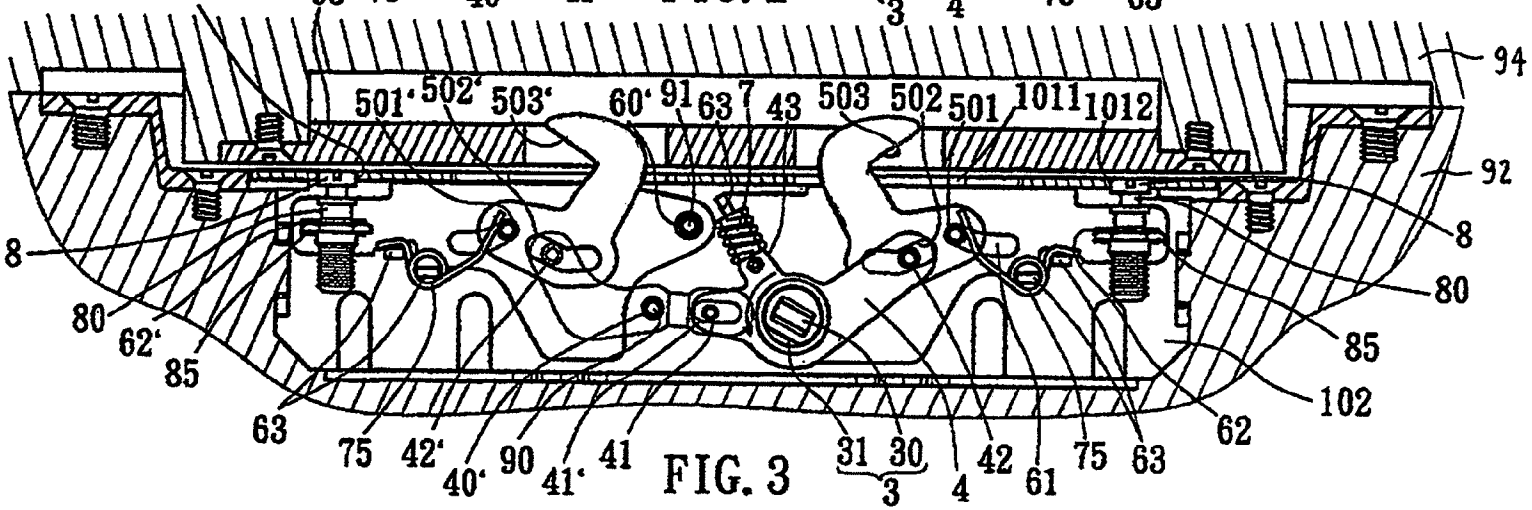
Figure 4:
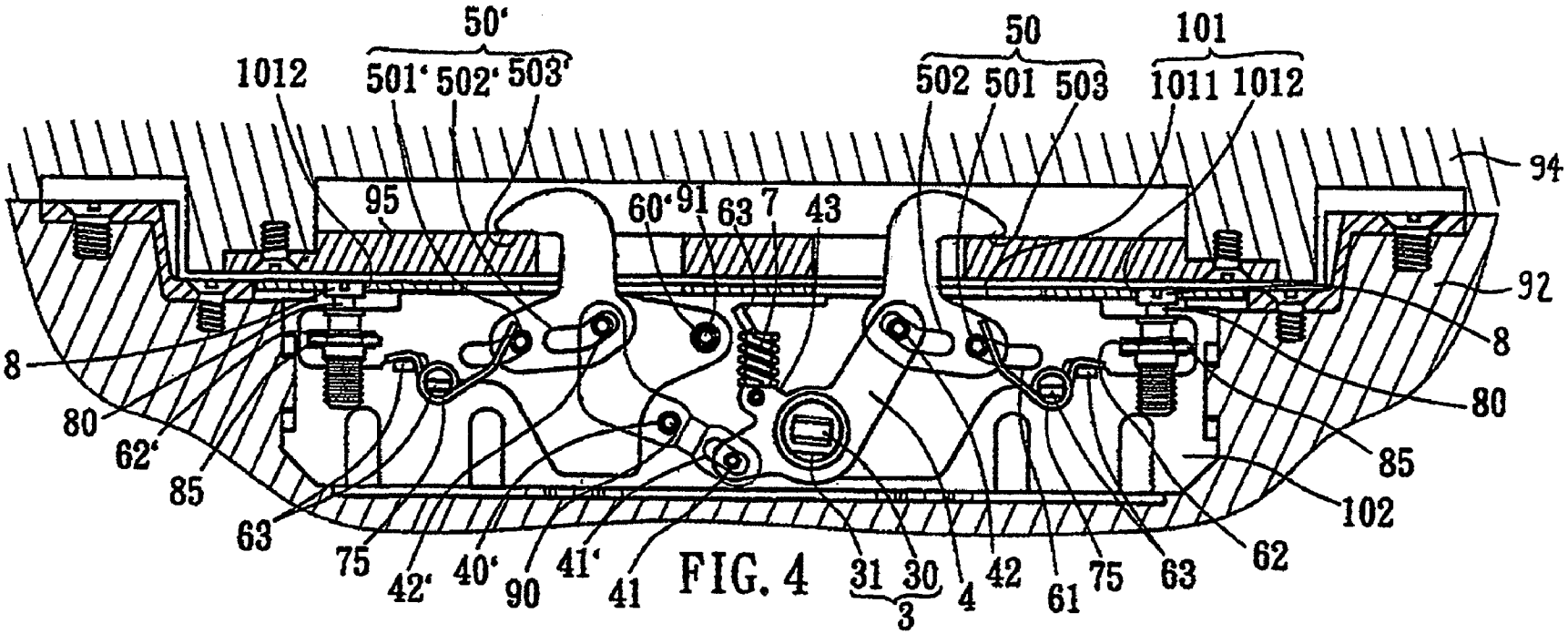
Figures 5, 6:
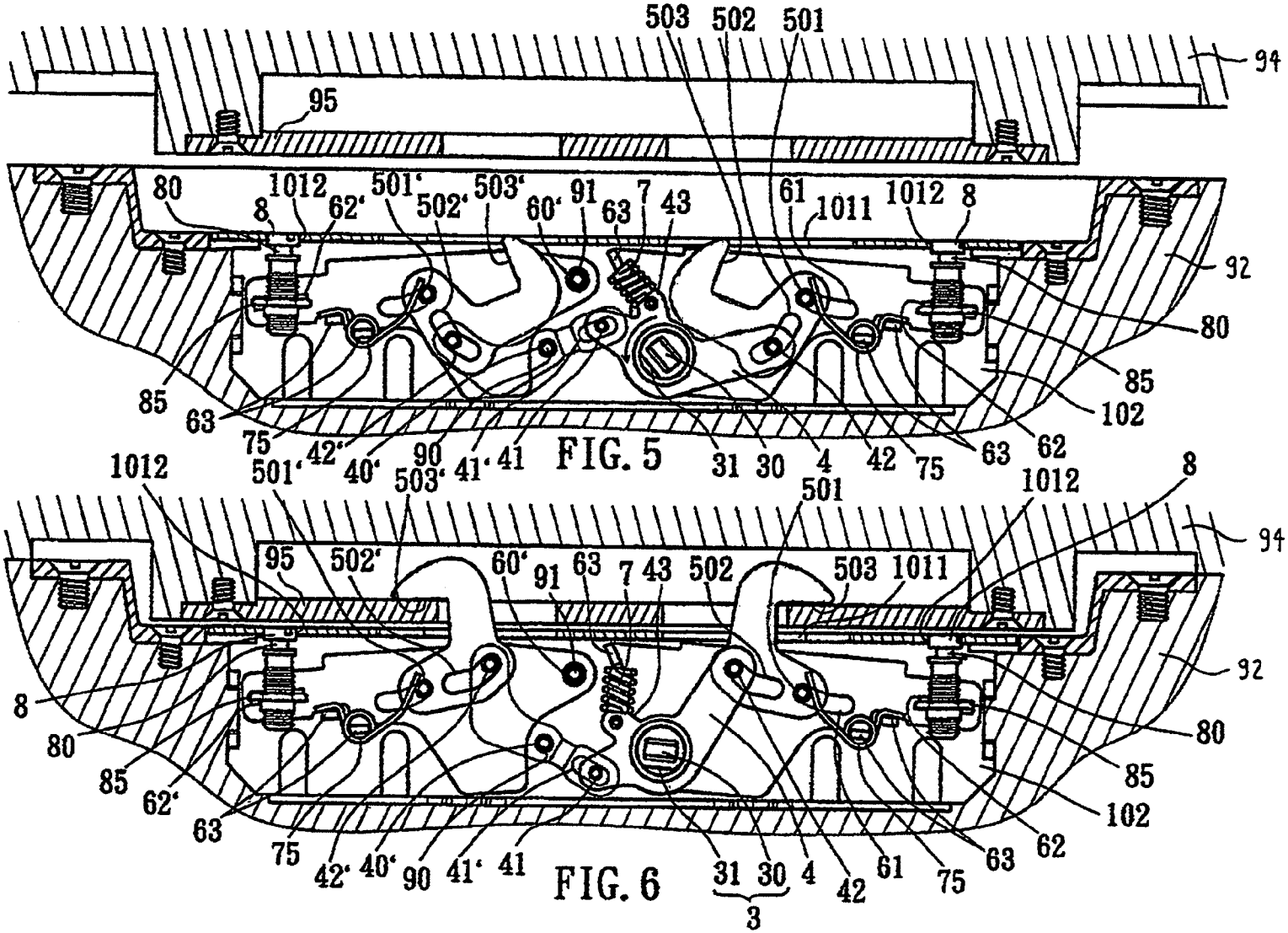
Figure 7:
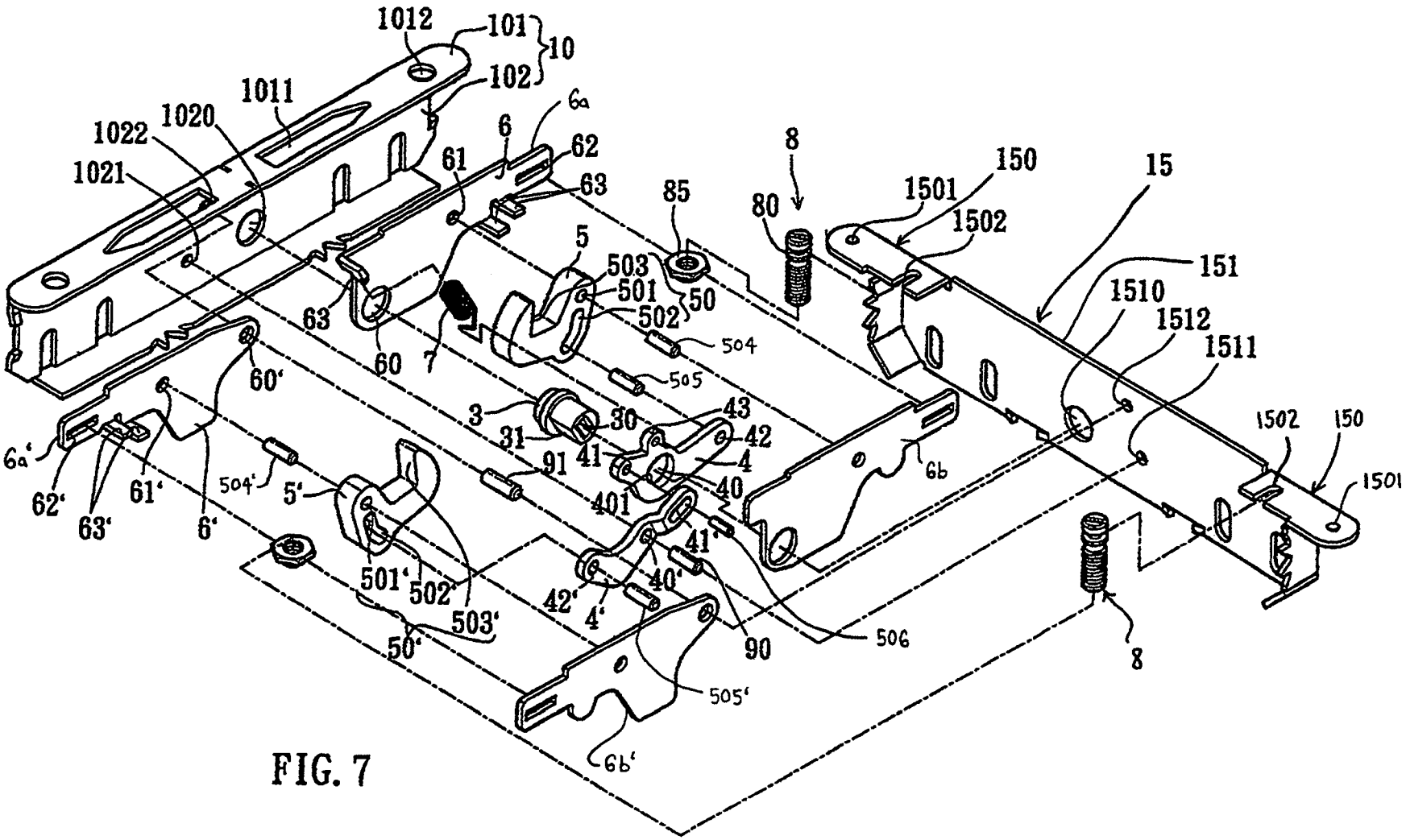

Having thus described the invention in general terms, reference will now be made to the accompanying drawings, which are not necessarily drawn to scale, and wherein:

FIG. 1 is an exploded view to illustrating the latch assembly according to one embodiment of the present invention;

FIG. 2 is a cross-sectional view illustrating the latch assembly of FIG. 1 with latch assembly installed in a sliding door and positioned relative to a door frame with a keeper structure, the two hooks of the latch assembly being shown in a retracted position;

FIG. 3 is a cross-sectional view illustrating the latch assembly of FIG. 1 with the door adjusted to a closed position against the door frame and the two hooks shown in a partially extended position, pivoted through the apertures in the base of the assembly;

FIG. 4 is a cross-sectional view illustrating the latch assembly of FIG. 1 with the two hooks shown in an extended position and hooked to the keeper structure;

FIG. 5 is a cross-section view illustrating the latch assembly of FIG. 1 with the two hooks retracted similar to FIG. 2 and with the adjusting knobs shown in a rotationally adjusted position relative to FIG. 2;

FIG. 6 is a cross-sectional view illustrating the latch assembly of FIG. 1 with the adjusting knobs rotated to the position of FIG. 5 and shown with the two hooks extended; and FIG. 7 is a cross-sectional view illustrating a latch assembly according to another embodiment of the present invention.

DETAILED DESCRIPTION OF THE INVENTION

The present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

The latch assembly of the present invention is typically provided in a door and used to secure the door in a closed, i.e., locked, position. For example, as described below, the door can be slidably mounted in a door frame in a wall. The latch assembly can be disposed in a recess or hollowed portion of the door proximate a keeper structure that is provided at the door frame so that, when the door is closed, the latch assembly can be used to engage the keeper structure and secure the door in the closed position, thereby locking the door. While the latch assembly is described below in an installation of a sliding exterior door that is engaged to a frame, it will be appreciated that the latch assembly can similarly be used in other types of doors or other portals and secured to another door or other structures. In any case, the two hooks of the latch assembly can operate in opposite directions such that the hooks engage the keeper structure regardless of the orientation of the latch assembly. That is, the latch assembly can have a "symmetric" configuration such that the latch assembly properly engages the keeper structure even if latch assembly and/or the keeper structure are reversed during installation, e.g., by installing either part upside down relative.

Referring now to FIGS. 1 to 4, the latch assembly of the present invention comprises a housing or case 1 including a base 10 and a cover 15, which is connected to the base 10 by fixing members or pins 90. The base 10 has a first outer surface 101 and a side wall 102. The first outer surface 101 has two apertures 1011 and two retaining holes 1012, and the side wall 102 has a plurality of holes 1020, 1021, 1022. A drive knob 3 is disposed at least partially in the housing 1 and rotatably mounted with a first end of the drive knob 3 extending through the hole 1020. A first end of each of two fixing members or pins 90, 91 are disposed in the holes 1021, 1022.

The cover 15 has a plurality of holes 1510, 1511, 1512 defined through a side 151 thereof and being in alignment with the holes 1020, 1021, 1022 in the side wall 102 of the housing 1. The cover 15 includes two flanges 150 on two ends thereof, and each flange 150 has a positioning hole 1501 and a recess 1502 which is located in alignment with one of the two retaining holes 1012 in the first outer surface 101 of the base 10. A second end of the drive knob 3 and two respective second ends of the fixing members 90, 91 are respectively engaged with the holes 1510, 1511, 1512 in the side 151 of the cover 15.

As illustrated, the drive knob 3 has a key hole 30 so that a user may rotate the drive knob 3 by inserting a key in the key hole 30 and rotating the drive knob 3. In some cases, the drive knob 3 can be configured to operate without a key, e.g., by rotation of a handle that extends from the drive knob 3. First and second adjusting members 6, 6' are located between the base 10 and the cover 15. The drive knob 3 extends through a through hole 60 in the first adjusting member 6, the hole 1020 in the side wall 102 of the base 10, a D-shaped through hole 40 in a first link 4, and the hole 1510 in the side 151 of the cover 15. The drive knob 3 further including a drive surface 31 which is engaged with a straight inside portion or flat 401 in an inner periphery of the through hole 40 of the first link 4. The first link 4 has first and second connection portions 41, 42 and a protrusion 43. The two connection portions 41, 42 are located on generally opposite sides of the through hole 40 and connected to a second link 4' and a first hook 5, respectively. The protrusion 43 is connected to an end of a spring 7 so as to torsionally compress the spring 7 when the first link 4 is pivoted.

The second link 4' has a through hole 40' that is located between the hole 1021 in the base 10 and the hole 1511 in the cover 15. The fixing member 90 extends through the holes 1021, 40', 1511 and thereby rotatably supports, i.e., pins, the second link 4' to the housing 1. The second link 4' has an adjusting portion 41' and a positioning portion 42' which are located at two sides of the through hole 40' and respectively connected to a second hook 5' and the first link 4.

Each hook 5, 5' includes a hook member 50, 50' that defines a hook end 503, 503', a retaining slot 502, 502', and a bore 501, 501'. Each hook member 50, 50' can include multiple members, such as multiple plate-like members as shown in FIGS. 1-4. Alternatively, each hook member 50, 50' can be a single, unitary member as described below in connection with FIG. 7. In either case, the bores 501, 501' of each hook member 50, 50' can receive a respective shaft or pin 504, 504', about which the members 50, 50' are configured to rotate.

The second connection portion 42 of the first link 4 and the positioning portion 42' of the link 4' are pivotably connected with the retaining slots 502, 502' by pins 505, 505'. The connection portion 41 on a first side of the through hole 40 of the first link 4 is pivotably connected to the adjusting portion 41' of the second link 4' by a pin 506, and the connection portion 42 on the opposite side of the through hole 40 of the first link 4 is pivotably connected to the pin 505 extending through the retaining slot 502 of the first hook 5. Similarly, the positioning portion 42' of the second link 4' is pivotably connected to the retaining slot 502' of the hook 5' by a the pin 505'.

As shown in FIG. 1, each of the adjusting members 6, 6' includes two portions, which are generally planar plates disposed in a substantially parallel configuration. That is, the first adjusting member 6 includes a first portion 6*a* and a second portion 6*b*, and, similarly, the second adjusting member 6' includes a first portion 6*a*' and a second portion 6*b*'. The two portions 6*a*, 6*b* of the first adjusting member 6 are configured to rotate together about the drive knob 3, and the two portions 6*a*', 6*b*' of the second adjusting member 6 are configured to rotate together about the pin 91. The first hook 5 is disposed between the two portions 6*a*, 6*b* of the first adjusting member 6, and the second hook 5' is disposed between the two portions 6*a*', 6*b*' of the second adjusting member 6'. The knob 3 can also define a circumferential ridge 3' that is disposed between the two portions 6*a*, 6*b* of the first adjusting member 6, i.e., such that a first end 3*a* of the knob 3 extends successively through the through hole 60 in the first adjusting member 6 and the hole 1020 in the side wall 102, and a second end 3*b* of the knob 3 extends successively through the D-shaped through hole 40 in the first link 4, the corresponding through hole 40 defined by the second portion 6*b* of the adjusting member 6, and the hole 1510 in the side 151 of the cover 15.

Each of the adjusting members 6, 6' includes a through hole 60, 60', a guiding slot 61, 61', a limiting slot 62, 62' and a positioning portion 63, 63'. The bores 501, 501' of the hooks 5, 5' are located in alignment with guiding slots 61, 61' of the adjusting members 6, 6' and pivotally connected thereto by the pins 504, 504'. First and second torsion springs 75, 75' are connected to the positioning portions 63, 63', respectively. A first end of each torsion spring 75, 75' is hooked to a respective one of the shafts 504, 504' and pushes the respective hook 5, 5' within the respective guiding slot 61, 61'. The limiting slots 62, 62' receive two nuts 85 therein and two adjusting knobs 8 are respectively movable in the two retaining holes 1012 in the first outer surface 101 and threadedly connected to the two nuts 85. The adjusting knobs 8 each have a neck portion 80 which is engaged with the recess 1502 corresponding thereto. Thus, the two nuts 85 are moved with the adjusting members 6, 6' by rotating the adjusting knobs 8.

As shown in FIGS. 2-4, the housing 1 can be disposed in a door 92, and configured with the first outer surface 101 directed toward a keeper structure in a door frame 94 so that the hooks 5, 5' can be selectively adjusted between a retracted position (FIG. 2) and an extended position (FIG. 4) to selectively unlock and lock the door. In the retracted position, the hooks 5, 5' are generally retracted into the housing 1 so that the door 92 can be moved away from the door frame 94 provided in the wall surrounding the door 92. A keeper structure is provided in the door frame 94 at a location proximate to the latch assembly when the door is closed so that the hooks can engage the keeper structure. In particular, the keeper structure can include a keeper board 95 that is screwed or otherwise connected to the door frame 94. The keeper board 95 typically defines one or more apertures through which the hooks 5, 5' can be extended so that the hooks 5, 5' can engage the keeper board 95 and thereby secure the door 92 against the door frame 94. In particular, the hooks 5, 5' can extend through the apertures and engage the keeper board 95 so that the keeper board 95 is disposed partially between the door and each hook end 503, 503'.

In order to lock the latch assembly, a key (not shown) is inserted in the drive knob 3 so that the drive knob 3 can be rotated. In the illustrated embodiment, the drive knob 3 is rotated in a counterclockwise direction to lock the latch assembly, though the assembly can be configured in other embodiments to operate in the opposite direction. As the drive knob 3 is rotated, the rotational force applied thereto is larger than the force of the spring 7 so that the drive surface 31 drives the flat 401 of the first link 4 and rotates the first link 4. As the first link 4 is rotated counterclockwise, the protrusion 43 of the first link 4 is moved toward the left. The adjusting portion 41 of the first link 4 is connected to the adjusting portion 41' of the second link 4', which is rotatably supported between the base 10 and the cover 15 by a pin 90 that extends through the hole 1021 of the base 10, the through hole 40' of the second link 4', and the hole 1511 of the cover 15. The second connection portion 42 of the first link 4 and the positioning portion 42' of the second link 4' are respectively connected to the retaining slots 502, 502' of the two hooks 5, 5', so that the rotation of the first link 4 drives the second link 4' to rotate clockwise about the through hole 40'. Thus, the hook 5 is rotated clockwise about the shaft 504, and the positioning portion 42' of the second link 4' drives the hook 5' to rotate counter clockwise about the shaft 504'. In this way, the hooks 5, 5' are rotatably extended outward through the apertures 1011 in the base 10 in a hooking fashion. The hooks 5, 5' are typically rotatably simultaneously between the retracted and extended positions, e.g., as illustrated in FIGS. 2-4.

The shafts 504 and 504' move within the guiding slots 61, 61' depending on the force of the torsion springs 75, 75'. The hooks 5, 5' are stopped when they hook on the keeper board 95 as shown in FIG. 4.

By rotating the drive knob 3 in the opposite direction, i.e., clockwise in the illustrated embodiment, the two hooks 5, 5' are hidden in the housing 1 and the sliding door can be opened as shown in FIG. 2.

The latch assembly 10 can be adjusted during installation according to the configuration and dimensions of a particular door and door frame. For example, FIGS. 5 and 6 illustrate an installation in which the latch assembly 10 is installed in a sliding door similar to that shown in FIGS. 1-4, but where the keeper structure that is installed in the door frame includes a keeper board 95 having a different thickness. In particular, the keeper board 95 of FIGS. 5 and 6 is thinner relative to the embodiment shown in FIGS. 1-4. In order to accommodate this different thickness, the latch assembly 10 is adjusted by rotating the adjusting knobs 8 and thereby moving the nuts 85 away from the first outer surface 101 of the base 10 and, hence, away from the keeper board 95. The nuts 85 are located in the limiting slots 62 so that the adjusting members 6, 6' are rotated about the through holes 60, 60' as the knobs 8 are adjusted. This also changes the positions of the hooks 5, 5' and, hence, the position of the hook ends 503, 503' when the hooks are extended. Thus, the hook ends 503, 503' can be extended to any desired position, e.g., to hook and engage the keeper board 95 as shown in FIG. 6. Similarly, the adjusting knobs 8 can be adjusted in the opposite direction to adjust the nuts 85 and, hence, the hooks 5, 5' to a position closer to the keeper structure, thereby extending the reach of the hooks 5, 5', e.g., to accommodate a thicker keeper board 95 such as is shown in FIGS. 1-4.

FIG. 7 illustrates another embodiment of the present invention in which the guiding slots 61, 61' are instead provided as holes and each of the hooks 5, 5' is provided as a single unitary piece, e.g., by forming each hook as a monolithic structure. In addition, FIG. 7 illustrates that the torsion springs 75, 75' on the positioning portions 63, 63' of the adjusting members 6, 6' can be omitted.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A latch assembly comprising:

a housing having a base and a cover connected to the base by first and second fixing members, the base having a first outer surface and a side wall, the first outer surface defining two apertures and two retaining holes, the side wall defining a plurality of holes, the cover defining a plurality of holes defined through a side thereof and being in alignment with the holes in the side wall, first ends of the fixing members extending through the holes in the side wall and second ends of the fixing members extending through the holes in the side of the cover;

first and second adjusting members located between the base and the cover;

a drive knob having a key hole, the drive knob defining first and second ends, the first end extending successively through a through hole in the first adjusting member and a hole in the side wall, the second end extending successively through a through hole in the second adjusting member and a hole in the side of the cover;

a first link having first and second connection portions and a protrusion and defining a through hole, the connection portions being located at two sides of the through hole of the first link, the drive knob extending through the through hole of the first link and defining a drive surface engaged with a straight inside portion in an inner periphery of the through hole of the link;

a second link having a through hole through which the first fixing member extends, the second link having an adjusting portion and a positioning portion which are located at two sides of the through hole, the adjusting portion being connected to the first connection portion of the first link;

first and second hooks, each hook having a bore, a retaining slot, and a hook end, the retaining slot of the first hook being pivotably connected to the second connection portion of the first link, and the retaining slot of the second hook being pivotably connected to the positioning portion of the second link; and a spring connected to the protrusion of the first link and configured to be compressed when the first link is pivoted, wherein the drive knob is configured to rotate the first and second links in opposite directions such that when the drive knob is rotated counterclockwise the first and second hooks are pivoted in opposite directions and extended through the apertures of the base.

2. A latch assembly according to claim 1 further comprising first and second adjusting knobs, wherein each of the adjusting knobs is movable in a respective one of the retaining holes in the first outer surface.

3. A latch assembly according to claim 2 wherein the cover includes two flanges on two ends thereof, each flange having a positioning hole and a recess located in alignment with a respective one of the retaining holes in the first outer surface of the base, the adjusting knobs each having a neck portion engaged with the respective recess.

4. A latch assembly according to claim 1 wherein the bores of the hooks are located in alignment with guiding slots of the adjusting members.

5. A latch assembly according to claim 1 wherein each of the adjusting members further includes a guiding slot, a limiting slot, and a positioning portion, and further comprising first and second torsion springs, each first torsion spring being connected to the positioning portion of a respective one of the adjusting members, and a first end of each torsion spring being a shaft extending through the bore of a respective one of the hooks such that the torsion spring pushes the respective hook within the respective guiding slot, and wherein each limiting slot receives a nut therein that is configured to move with a respective one of the adjusting members.

6. A latch assembly for use in a sliding door for securing the door relative to a keeper structure of a door frame, the latch assembly comprising:

a housing defining a first outer surface, the housing being configured to be disposed in the door with the first outer surface directed toward the door frame;

a drive knob disposed in the housing and rotatably mounted to the housing;

first and second links rotatably mounted in the housing, the first link defining an aperture for receiving the drive knob such that the first link is rotatable about the drive knob, the second link being pinned to the housing and engaged to the first link such that the second link is configured to rotate in a direction opposite to a rotation of the drive knob and the first link;

first and second adjusting members disposed in the housing and rotatably mounted to the housing, each adjusting member defining a slot;

first and second hooks rotatably mounted in the housing, each hook defining a slot and each hook defining a hook end; and first, second, third, and fourth pins, the first pin extending through the first link and the slot in the first hook, the second pin extending through the second link and the slot in the second hook, the third pin extending through the first hook and the slot in the first adjusting member, and the fourth pin extending through the second hook and the slot in the second adjusting member, such that the first and second hooks are configured to rotate in opposite directions and the hooks are configured to be selectively rotated between a retracted position and an extended position by a rotation of the drive knob, such that during adjustment to the extended position the hook ends extend from the casing and rotate to engage the keeper structure with the keeper structure disposed partially between each hook end and the door.

7. A latch assembly according to claim 6 further comprising first and second adjusting knobs, each knob being engaged with a respective one of the adjusting members and extending to the first outer surface, each knob being configured to be adjusted to adjust a position of the respective adjusting member relative to the first outer surface and thereby adjust the extended position of each hook end.

8. A latch assembly according to claim 7 wherein each of the adjusting knobs is rotatably connected to the housing and engaged via a threaded connection to the adjusting members such that the knobs are configured to be rotated after the latch assembly is installed in the door to adjust a distance defined between the first outer surface and a portion of each adjusting member and thereby adjust a distance defined between each hook end and the first outer surface when the hooks are in the extended position.

9. A latch assembly according to claim 6 wherein the housing includes a base and a cover, each of the base and cover extending perpendicular to the first outer surface and defining a space therebetween, the drive knob extending through the base and cover, each of the first and second links and first and second adjusting members being disposed between the base and cover and pinned between the base and cover, and each of the first, second, third, and fourth pins extending in an axial direction between the base and cover and configured to adjust in a transverse direction perpendicular to the axial direction when the drive knob is rotated.

10. A latch assembly according to claim 6, further comprising at least one spring, and wherein at least one of the links defines a protrusion connected to the spring such that the protrusion is configured to compress the spring when the links are rotated by the drive knob.

11. A latch assembly according to claim 6, further comprising first and second springs, the first spring being connected to the third pin and the first adjusting member and configured to bias the third pin toward a first end of the slot in the first adjusting member, and the second spring being connected to the fourth pin and the second adjusting member and configured to bias the fourth pin toward a first end of the slot in the second adjusting member.

12. A latch assembly according to claim 6 wherein the housing comprises at least one flange extending parallel to the first outer surface and defining first and second recesses, each of the adjusting knobs having a neck disposed in and retained by one of the recesses, and wherein the first outer surface defines holes corresponding in position to each adjusting knob such that the knobs are configured to be accessed and adjusted through the first outer surface.

13. A latch assembly according to claim 6 wherein each adjusting member defines first and second substantially parallel portions, and wherein each of the hooks is disposed between the first and second portions of a respective one of the adjusting members.

14. A latch assembly according to claim 13, further comprising first and second nuts, and wherein each of the parallel portions of the adjusting members defines a limiting slot, the first nut being mounted in the limiting slots of the first and second parallel portions of the first adjusting member and threadably engaged to the first adjusting knob, and the second nut being mounted in the limiting slots of the first and second parallel portions of the second adjusting member and threadably engaged to the second adjusting knob.

15. A latch assembly according to claim 6 wherein each of the hooks is a single unitary member.

* * * * *

UNITED STATES PATENT AND TRADEMARK OFFICE

CERTIFICATE OF CORRECTION

PATENT NO. : 7,604,265 B2
APPLICATION NO. : 11/389987
DATED : October 20, 2009
INVENTOR(S) : Miao Hsueh Tsai It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 544 days.

Signed and Sealed this

Fifth Day of October, 2010

David J. Kappos

David J. Kappos
*Director of the United States Patent and Trademark Office*